US006799008B1

(12) United States Patent
Lim

(10) Patent No.: US 6,799,008 B1
(45) Date of Patent: Sep. 28, 2004

(54) ELECTRO PHOTO MULTI FUNCTIONAL PERIPHERAL APPARATUS

(75) Inventor: Deuk-Sung Lim, Yongin (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 253 days.

(21) Appl. No.: 09/603,595

(22) Filed: Jun. 26, 2000

(30) Foreign Application Priority Data

Jun. 24, 1999 (KR) ..... 1999/23879

(51) Int. Cl.[7] ..... G03G 21/16

(52) U.S. Cl. ..... 399/124; 271/3.24; 271/264; 399/21; 399/401

(58) Field of Search ..... 399/361, 388, 399/391, 18, 21, 16, 19, 124, 405, 401, 407, 110, 111; 271/3.24, 9.01, 9.07, 9.08, 9.13, 256, 268, 264, 279, 289, 290, 292, 298, 301

(56) References Cited

U.S. PATENT DOCUMENTS 4,605,299 A * 8/1986 Mochimaru ..... 399/111
4,669,896 A * 6/1987 Yokota et al.
4,755,855 A * 7/1988 Watanabe ..... 399/401 X
4,787,616 A * 11/1988 Sasaki et al. ..... 271/298 X
4,835,567 A * 5/1989 Ogata ..... 399/124
4,935,786 A * 6/1990 Veeder ..... 399/401
4,949,134 A * 8/1990 Iwaki et al.
5,030,991 A * 7/1991 Zaitsu et al. ..... 399/401 X
5,088,714 A * 2/1992 Nagasawa et al.
5,132,719 A * 7/1992 Kioka et al. ..... 399/361 X
5,203,552 A * 4/1993 Hoshi et al. ..... 271/9.01
5,277,418 A * 1/1994 Jones et al.
5,293,203 A * 3/1994 Wada et al. ..... 271/301 X
5,322,274 A * 6/1994 Takahashi et al. ..... 271/256 X
5,379,101 A * 1/1995 Takahashi et al. ..... 399/110
5,573,072 A * 11/1996 Evans et al.
5,588,517 A * 12/1996 Kooy et al.
5,887,924 A * 3/1999 Green et al.
5,913,476 A * 6/1999 Gonidec et al.
5,944,307 A * 8/1999 Yim
6,112,047 A * 8/2000 Kato et al. ..... 271/279
6,145,828 A * 11/2000 Arai ..... 399/124 X
6,204,872 B1 * 3/2001 Hashimoto et al. .... 271/9.01 X
6,510,290 B2 * 1/2003 Muto ..... 399/18

FOREIGN PATENT DOCUMENTS

JP 10-324435 * 12/1998
JP 11-079427 * 3/1999

OTHER PUBLICATIONS

Tominaka, "Medium Processing Device", Dec. 8, 1998, Japan, 10–324435, translation done by Schreiber Translations, Inc.*

* cited by examiner

*Primary Examiner*—Susan S. Y. Lee
(74) *Attorney, Agent, or Firm*—Robert E. Bushnell, Esq.

(57) ABSTRACT

An electro photo multi functional peripheral apparatus comprises a main body which is provided with an optional device such as a duplex module, a sorter, a power stacker and a large scale paper feeding unit at one side thereof. A feeding unit for feeding a recording paper is mounted at the other side of the main body. A feeding cassette is mounted at a lower portion of the main body. A multipurpose feeding unit assembly is removably mounted at a center portion of the main body and horizontally transports the recording paper fed from the feeding unit. The main body is formed with a first, a second and a third paper transport paths for discharging the recording paper fed from the multipurpose feeding unit assembly, the feeding cassette and the duplex module, respectively.

17 Claims, 10 Drawing Sheets

ELECTRO PHOTO MULTI FUNCTIONAL PERIPHERAL APPARATUS

CLAIM OF PRIORITY

This application makes reference to, incorporates the same herein, and claims all benefits accruing under 35 U.S.C. §119 from my application ELECTRO PHOTO MULTI FUNCTIONAL PERIPHERAL APPARATUS filed with the Korean Industrial Property Office on Jun. 24, 1999 and there duly assigned Ser. No. 23879/1999.

BACKGROUND OF THE INVENTION

1. Field of the Invention

The present invention relates to an electro photo multi functional peripheral apparatus, more particularly, to an electro photo multi functional peripheral apparatus which has various paper transport paths and allows a jammed paper sheet to be easily removed.

2. Description of the Related Art

Generally, in order to perform various functions, an electro photo multi functional peripheral apparatus includes various separate optional auxiliary devices such as a sorter, a power stacker and a large scale paper feeding unit, and also has various types of paper transport paths to effectively feed recording papers.

FIG. 1 is a schematic view showing a L-type paper transport path of a conventional electro photo multi functional peripheral apparatus. It is advantageous that the entire length of the L-type paper transport path be short. However, if an optional auxiliary device 2 such as a power stacker is mounted, since the paper transport path is leaned to a left side of a main body 1, optional auxiliary device 2 is overlapped with a feeding unit 3. Therefore, it is difficult or impossible to use the optional device and the feeding unit at the same time. Thus, there is a disadvantage in an expansibility of the optional device.

FIG. 2 is a schematic view showing a S-type paper transport path of a conventional electro photo multi functional peripheral apparatus. In this type, a separate rack is needed to mount optional auxiliary device 2.

In the conventional electro photo multi functional peripheral apparatus as disclosed above, since it is not easy to use optional auxiliary device 2, the reliability of the apparatus is lowered. Further, since the entire paper transport path is located in main body 1, it is not easy to remove a jammed paper sheet.

Particularly, when a paper jam occurs and is detected, it is very complicated to remove the jammed paper sheet. First, a top cover 4 is opened and a developer 5 is taken out of the main body. Then, the jammed paper sheet is removed. After that, the developer is received again in the main body and the top cover is closed. Further, in case the jammed paper sheet is mechanically caught by a roller, it is very difficult to remove the jammed paper sheet, since the jammed paper sheet is crumpled or torn.

SUMMARY OF THE INVENTION

Accordingly, an object of the present invention is to provide an electro photo multi functional peripheral apparatus which has various paper transport paths so as to increase the expansibility of an optional device.

Another object of the present invention is to provide an electro photo multi functional peripheral apparatus which allows a jammed paper sheet to be easily removed after it has been detected.

In order to accomplish the above object, the present invention provides an electro photo multi functional peripheral apparatus comprising a main body which is provided with an optional auxiliary device such as a duplex module, a sorter, a power stacker or a large scale paper feeding unit located at one side thereof. A feeding unit for feeding sheets of recording paper is mounted at the other side of the main body. A feeding cassette is mounted at a lower portion of the main body. A multipurpose feeding unit assembly is removably mounted at a center portion of the main body and horizontally transports the recording paper fed from the feeding unit. The main body is formed with a first, a second, and a third paper transport paths for discharging the recording paper and paper fed from the multipurpose feeding unit assembly, the feeding cassette and the duplex module, respectively.

In another aspect of the present invention, there is provided an electro photo multi functional peripheral apparatus comprising a main body having an optional device such as a sorter, a power stacker, a large scale paper feeding unit and a multipurpose feeding unit at one side thereof. A feeding unit for feeding a recording paper is mounted at the other side of the main body. A multipurpose feeding unit assembly is removably mounted at a center portion of the main body and horizontally transports the recording paper fed from the feeding unit. The multipurpose feeding unit assembly comprises a jammed paper removing means for easily removing a jammed paper.

Preferably, the multipurpose feeding unit assembly comprises a rectangular base member. At least one or more cover plates are mounted on an upper face of the base member, paper feeding means for feeding the recording paper is mounted at the base member and the cover plate. A power transmitting means transmits power to the paper feeding means. A guiding means guides a backward and forward movement of the multipurpose feeding unit assembly.

Preferably, the paper feeding means comprises a plurality of feeding rollers which are mounted at an interval on a rear side of the base member and are rotated by the power transmitting means. A plurality of pinch rollers are rotatably mounted at the cover plates, so as to be respectively opposite to the feeding rollers.

Preferably, the jammed paper removing means is composed so that one of the cover plates is formed to be revolved with a hinge shaft in the center and an elastic member is provided between the cover plate and the base member.

Preferably, the guiding means comprises guiding rollers which are rotatably mounted on both sides of the base member.

Preferably, the electro photo multi functional peripheral apparatus further comprises a front cover which is fixed to a front face of the base member. The front cover has a grasping groove at a center portion thereof to facilitate operation of receiving and withdrawing the multipurpose feeding unit assembly, by the grasping groove.

Preferably, the electro photo multi functional peripheral apparatus further comprises a plurality of position guiding members, which are fixed to a rear side of the base member, and a plurality of position guiding holes, which are formed at an inner portion of the main body. The position guiding members are respectively inserted thereinto.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

In the following, a preferred embodiment of the present invention is described in detail with reference to FIGS. 1 to 5.

Figure 1:
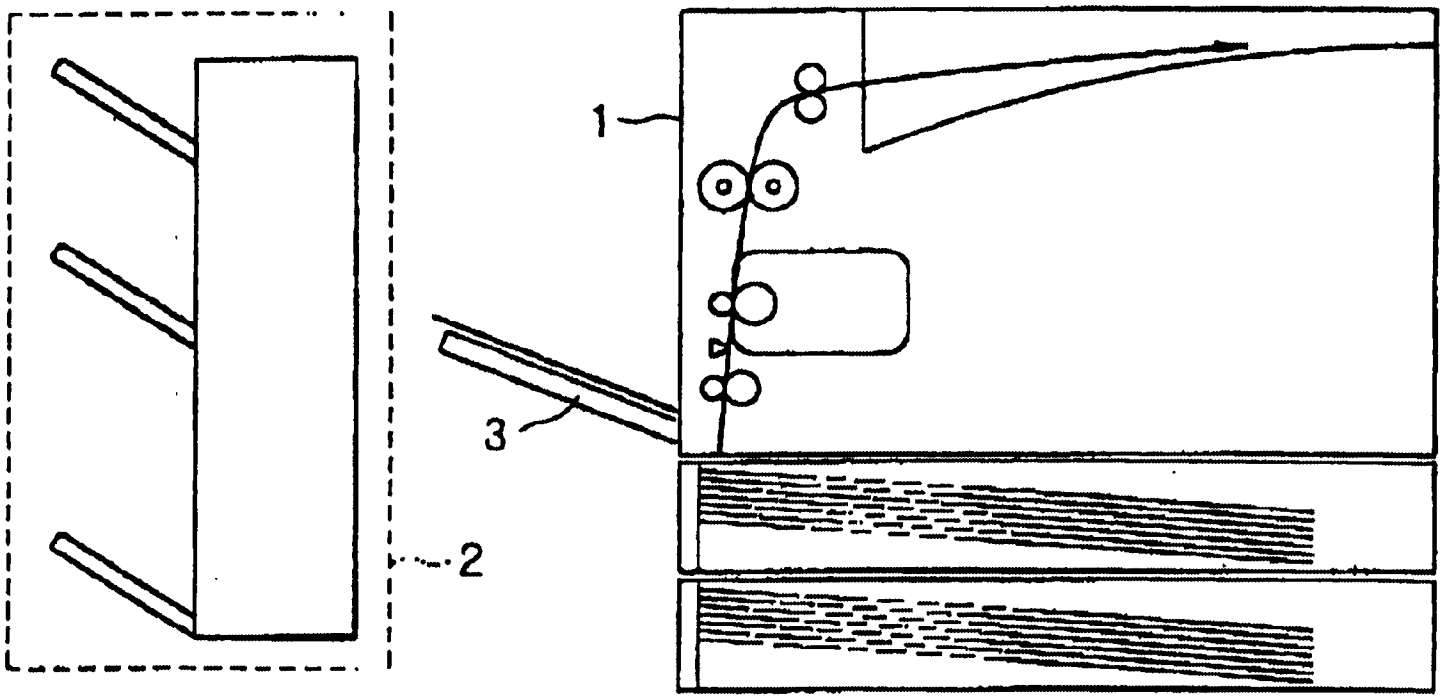
FIG. 1 (Prior Art)
FIG. 1 is a schematic view showing a L-type paper transport path of a conventional electro photo multi functional peripheral apparatus.
Figure 2:
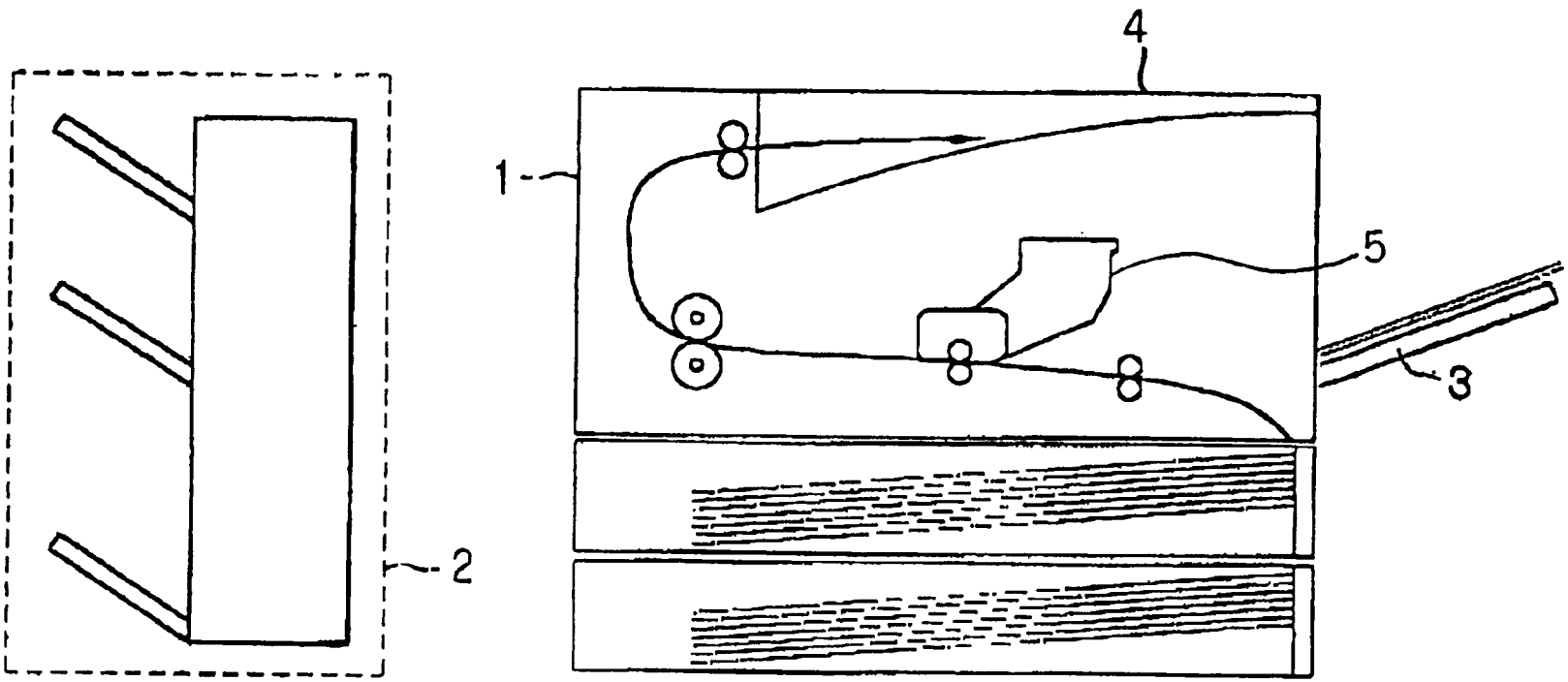
FIG. 2 (Prior Art)
FIG. 2 is a schematic view showing a S-type paper transport path of a conventional electro photo multi functional peripheral apparatus.

FIG. 1 is a schematic view showing a L-type paper transport path of a conventional electro photo multi functional peripheral apparatus. FIG. 2 is a schematic view showing a S-type paper transport path of the conventional electro photo multi functional peripheral apparatus. In this type, a separate rack is needed to mount an optional device 2, such as a scanner.

In the conventional electro photo multi functional peripheral apparatus as disclosed above, since it is not easy to use optional device 2, the reliability of the apparatus is lowered. Further, since all of the paper transport paths are formed in main body 1, it is not easy to remove a jammed paper sheet when paper sheet is jammed.

Figure 3:
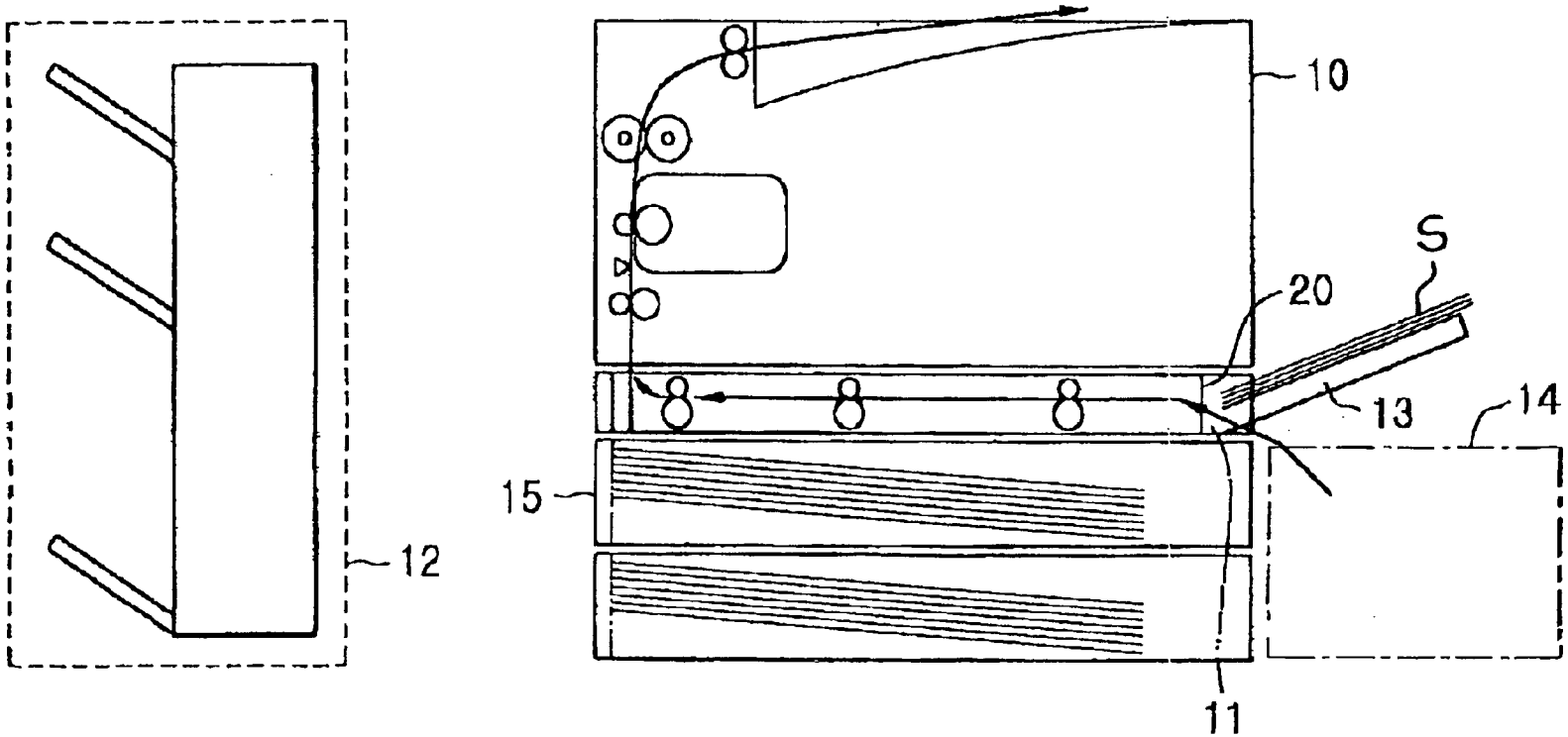
FIG. 3 is a schematic view showing a structure of an electro photo multi functional peripheral apparatus according to the present invention.

FIG. 3 is a schematic view showing a structure of an electro photo multi function peripheral apparatus according to the present invention. As shown in FIG. 3, the electro photo multi functional peripheral apparatus according to the present invention is provided with a separate receiving space 11 at a center portion of a main body 10. A separate multipurpose feeding unit assembly 20 for horizontally transporting a paper sheet is removably mounted in receiving space 11. Therefore, when a paper jam occurs in multipurpose feeding unit assembly 20, the jammed paper sheet can be easily removed. The electro photo multi functional peripheral apparatus has a simple structure to secure the expansibility of the optional device easily permits removal of jammed paper sheets.

The L type paper transport path in FIG. 1 is used here as a basic design. Multipurpose feeding unit assembly 20 is mounted at the center portion of main body 10, whereby an entire structure of the paper transport path is formed into the S type.

An optional device 12 is mounted at one side of main body 10. A feeding unit 13 is mounted at the other side of main body 10. Paper sheets fed from feeding unit 13 are horizontally transported along multipurpose feeding unit assembly 20 and then discharged along an upper side of main body 10. Further, if necessary, a large scale cassette 14 is mounted at the side of main body 10, so that the paper sheet can be fed to multipurpose feeding unit assembly 20. Alternatively, the paper sheet can be fed from a feeding cassette 15 located at a lower portion of main body 10 and vertically transported and then discharged, whereby the paper transport path can be formed into various types.

Figure 4:
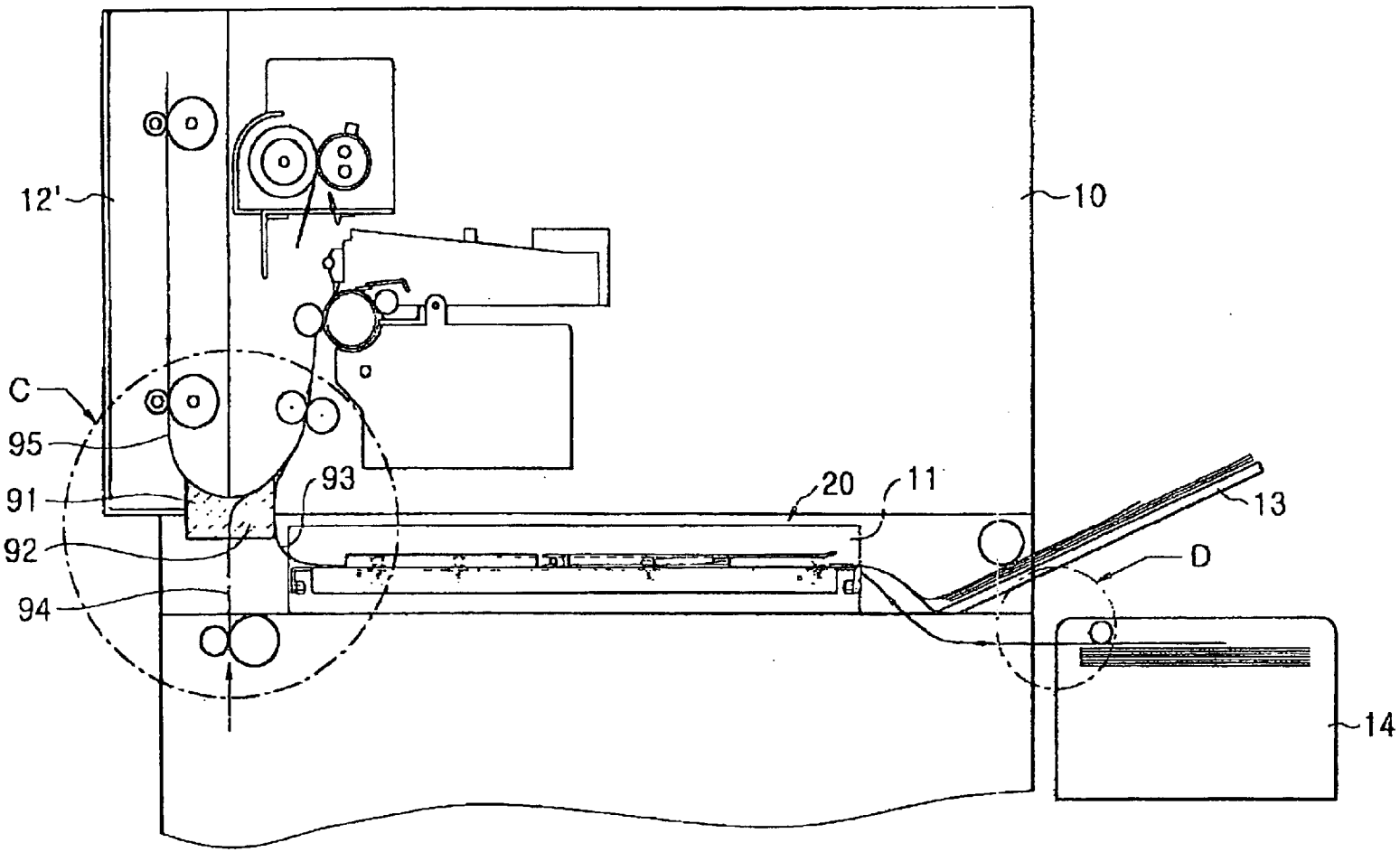
FIG. 4 is a schematic view of an embodiment of the electro photo multi functional peripheral apparatus according to the present invention.
Figure 5:
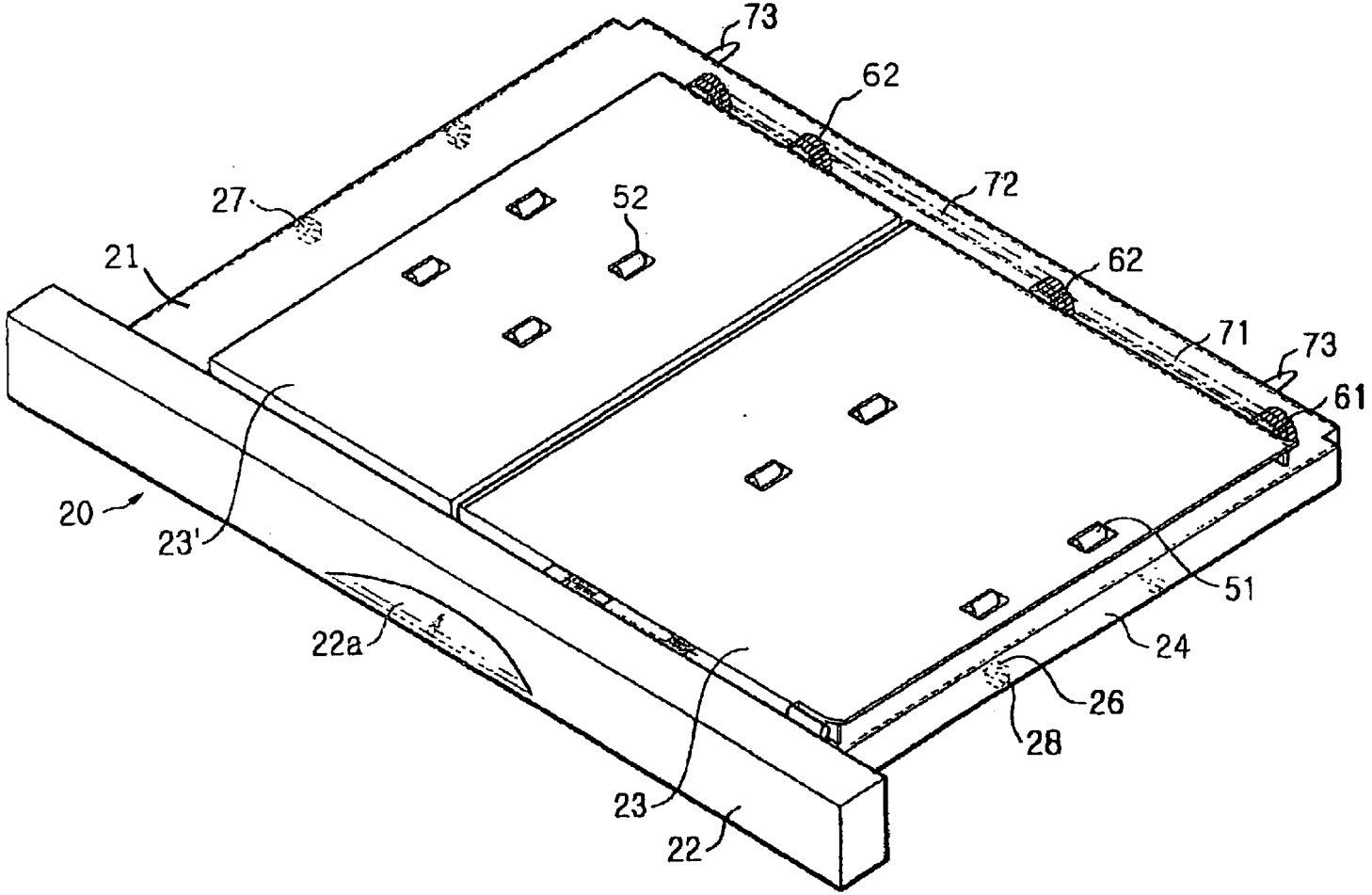
FIG. 5 is a perspective view of a multipurpose feeding unit assembly of the electro photo multi functional peripheral apparatus according to the present invention.

In an embodiment of the electro photo multi functional peripheral apparatus of the present invention, as shown in FIG. 4, a duplex module 12' as one optional device may be mounted at one side of main body 10. Duplex module 12' uprightly feeds a recording paper from an upper portion of the main body 10.

Duplex module 12' may be removably mounted at main body 10 or fixedly mounted at main body 10. In the following embodiment of the present invention duplex module 12' is attached to the main body 10. As shown in FIGS. 5 to 10, multipurpose feeding unit assembly 20 comprises a rectangular base member 21. A guiding means is disposed at a portion of base member 21 and guides a backward and forward movement of multipurpose feeding unit assembly 20. A front cover 22 is fixed to a front face of base member 21. At least one cover plate 23 is mounted on an upper face of base member 21. A paper feeding means is mounted at base member 21 and cover plate 23. A power transmitting means transmits power to the paper feeding means. A jammed paper removing means easily removes a jammed paper sheet when the sheet has become jammed.

In addition, bent-down portions 24 and 25 are respectively formed at both side ends of base member 21. Guiding rollers 26 and 27 are rotatably mounted at the insides of bent-down portions 24 and 25. Guiding rollers 26 and 27 are rotatably supported by supporting shafts 28 and 29. Multipurpose feeding unit assembly 20 can be moved backward and forward by guiding rollers 26 and 27, so as to be slidingly received in receiving space 11 of main body 10.

A grasping groove 22*a* is formed at a center portion of front cover 22. Therefore, operation of receiving and withdrawing multipurpose feeding unit assembly 20 is easily performed by grasping groove 22*a*.

Cover plates 23 and 23' are mounted on the upper face of base member 21 so as to have a desired height difference between cover plates 23 and 23'. Base member 21 transports the recording paper therebetween. A paper feeding means is provided at each of base member 21 and the cover plates 23 and 23'.

A plurality of roller shafts 31 and 32 are rotatably supported at an interval on a rear side of base member 21. A plurality of feeding rollers 41 and 42 are respectively fixed to roller shafts 31 and 32. Feeding rollers 41 and 42 are outwardly protruded through openings 21*b* formed on base member 21.

A plurality of pinch rollers 51 and 52 are rotatably mounted at a bottom face of cover plates 23 and 23' by supporting means such as brackets, etc. so as to be opposite to feeding rollers 41 and 42 of base member 21. Pinch rollers 51 and 52 are closely contacted with feeding rollers 41 and 42 so as to be rotated by rotational operations of feeding rollers 41 and 42 and feed the recording papers. Pinch rollers 51 and 52 are slightly protruded outwardly through openings 23*a* and 23*a*' formed on cover plates 23 and 23'.

The power transmitting means comprises pulleys 61 and 62 which are fixedly coupled to each end of roller shafts 31 and 32 and belts 71 and 72 which connect pulleys 61 and 62 with each other to transmit rotational power. A transmission gear 35 is fixed to outmost roller shaft 34 (or 31) out of roller shafts 31 and 32. Transmission gear 35 is rotated by a power generating means such as a motor. Thus, entire roller shafts 31 and 32 are rotated in a direction.

Transmission gear 35 is engaged with a gear receiving power from a power generating means when multipurpose feeding unit assembly 20 is completely received in receiving space 11.

A plurality of position guiding members 73 are fixed to a rear side of base member 21. Position guiding members 73 are respectively inserted into position guiding holes 74 formed at an inner portion of main body 10. Position guiding holes 74 precisely guide the position of multipurpose feeding unit assembly 20 and prevent multipurpose feeding unit assembly 20 received in receiving space 11 from being arbitrarily moved forward.

The jammed paper removing means is so constructed that a one of cover plates 23 and 23' is formed to be revolved with a hinge shaft 81 in the center and an elastic member such as a tension coil spring 82 is provided between cover plate 23 and base member 21.

A grasping portion 83 is formed at an end of cover plate 23 so as to facilitate an operation of opening cover plate 23. Grasping portion 83 is slightly bent upward.

The jammed paper removing means may be advantageously provided at the other cover plate 23'.

Preferably, in order to prevent multipurpose feeding unit assembly 20 from being completely withdrawn when multipurpose feeding unit assembly 20 is forward moved to remove the jammed paper, a separate latching means is provided in receiving space 11. For example, latching portions are respectively formed in each portion of base member 21 and receiving space 11, so that multipurpose feeding unit assembly 20 is caught by the latching portions when the withdrawing operation of multipurpose feeding unit assembly 20 is completed.

Figure 11:
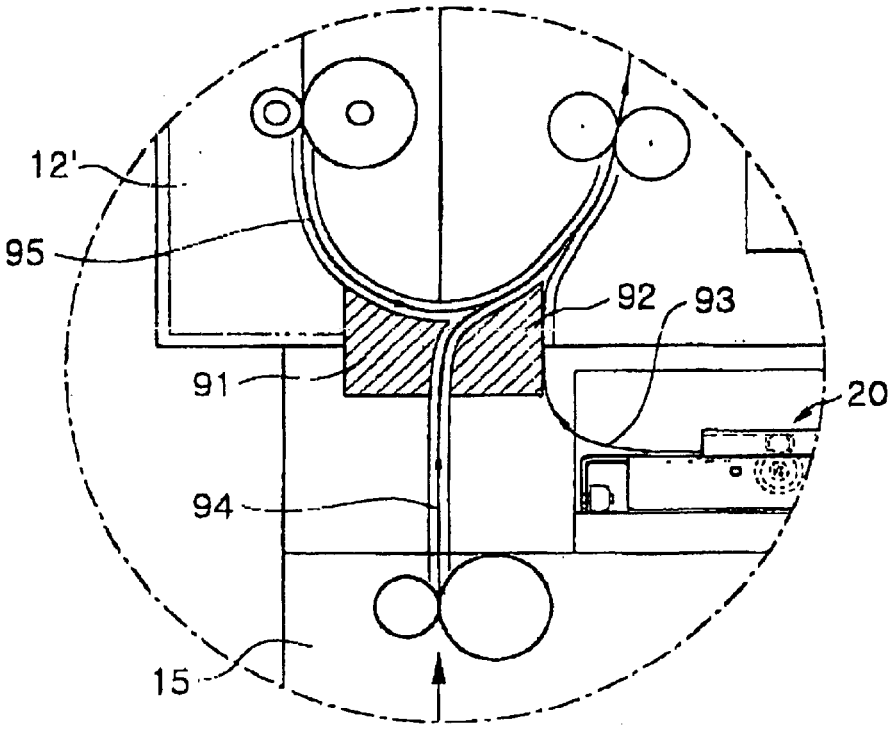
FIG. 11 is an enlarged view of a C portion of FIG. 4.

Duplex module 12' is advantageously provided at one side of main body 10, as shown in FIG. 11. The electro photo multi functional peripheral apparatus of the present invention then further comprises a first guiding chute 91 and a second guiding chute 92, which are mounted at an inside of main body 10. A first paper transport path 93 guides a paper sheet fed from multipurpose feeding unit assembly 20. A second paper transport path 94 guides a paper sheet fed from feeding cassette 15. A third paper transport path 95 guides a paper sheet fed from duplex module 12'.

Figure 12:
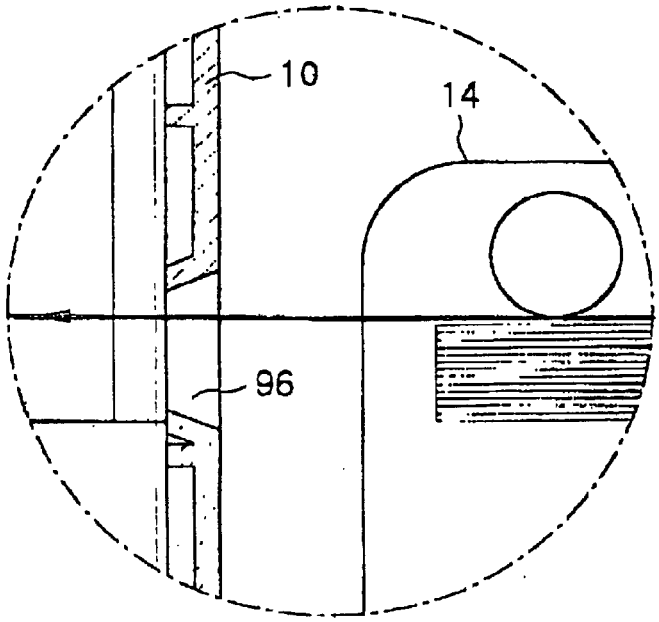
FIG. 12 is an enlarged view of a D portion of FIG. 4.

Further, as shown in FIG. 12, if large scale cassette 14 is used, paper sheets fed from large scale cassette 14 are fed through a paper-receiving opening 96 formed in a portion of main body 10 and then continuously fed along multipurpose feeding unit assembly 20.

In the electro photo multi functional peripheral apparatus according to the present invention as described above, separate multipurpose feeding unit assembly 20 is adapted to be received in receiving space 11 and used as a part of the paper transport path. Therefore, if the recording paper fed from feeding unit 13 is entered into multipurpose feeding unit assembly 20, feeding roller 41 and 42 and pinch roller 51 and 52 are rotated by the transmission means and transports the recording paper. And then, the recording paper discharged to an outlet of the multipurpose feeding unit assembly 20 is transported along first paper transport path 93 formed by second guiding chute 92 to a predetermined location as shown in FIG. 11.

If separate large scale cassette 14 is used, as shown in FIG. 12, recording paper fed from large scale cassette 14 enters through a paper-receiving opening 96, formed in a portion of main body 10, and is then transported through the paper path, which is the same in multipurpose feeding unit assembly 20, to first paper transport path 93.

If a feeding cassette mounted in main body 10 is used instead of large scale cassette 14, the recording paper is transported through a second paper transport path 94 formed between first guiding chute 91 and second guiding chute 92. When duplex module 12' is used, the recording paper is transported along a third paper transport path 95 formed by first guiding chute 91 and second guiding chute 92.

Figure 6:
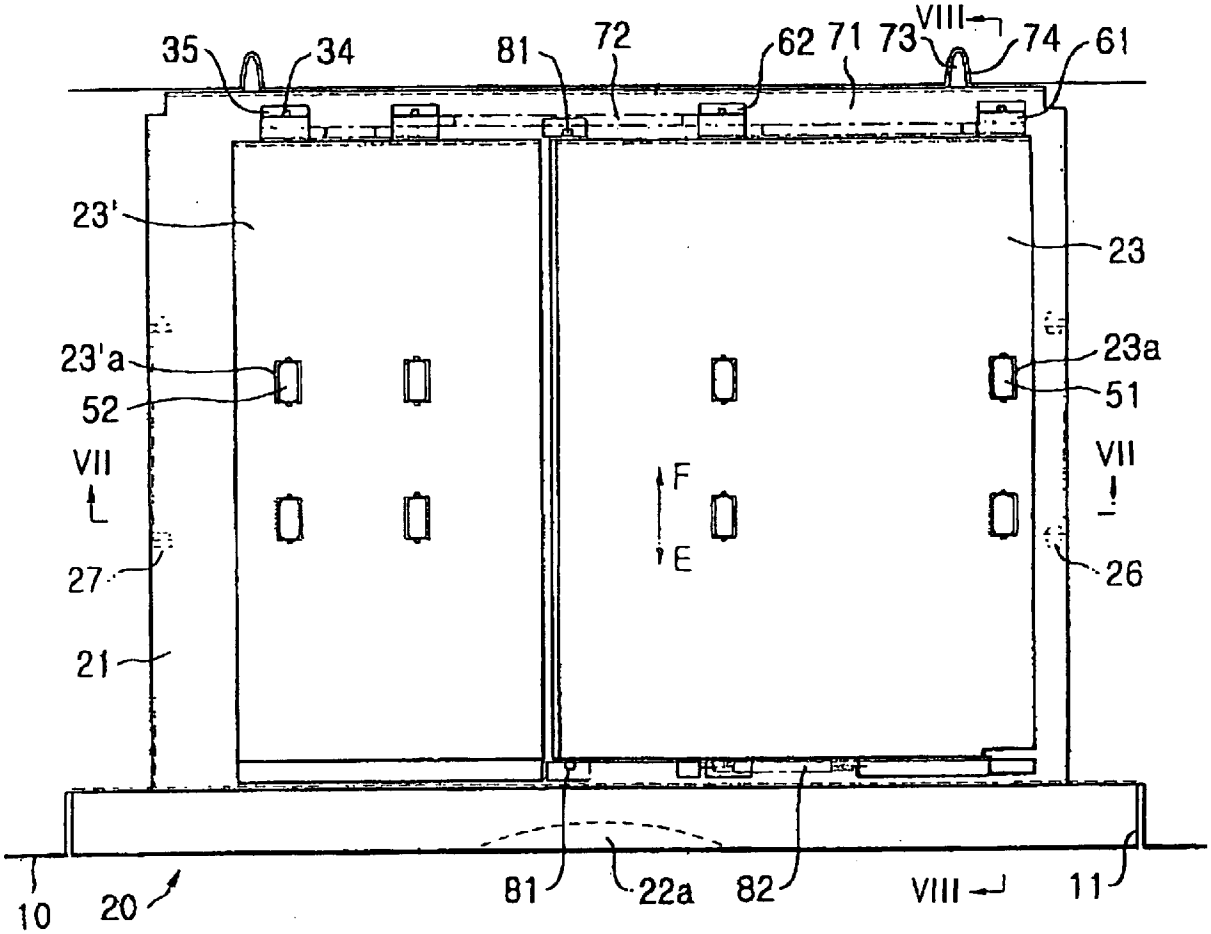
FIG. 6 is a plan view of the multipurpose feeding unit assembly of the electro photo multi functional peripheral apparatus according to the present invention.
Figure 7:
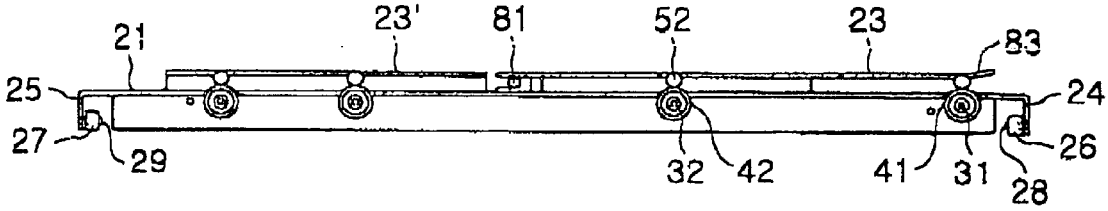
FIG. 7 is a cross sectional view taken along a line VII—VII of FIG. 6.
Figure 8:
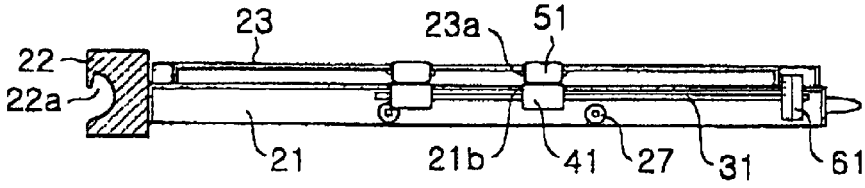
FIG. 8 is a cross sectional view taken along a line VIII—VIII of FIG. 6.
Figure 9:
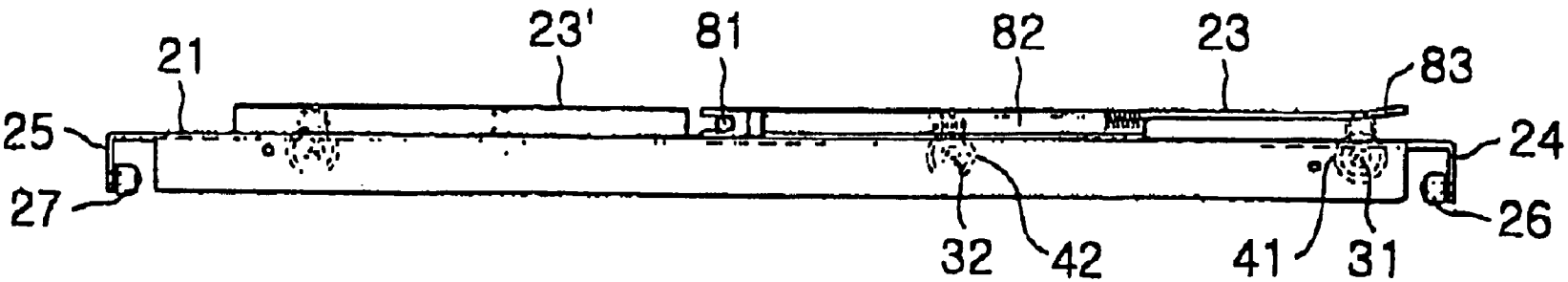
FIG. 9 is a front view showing a state that cover plate is closed in order to explain an operation of removing a jammed paper sheet.
Figure 10:
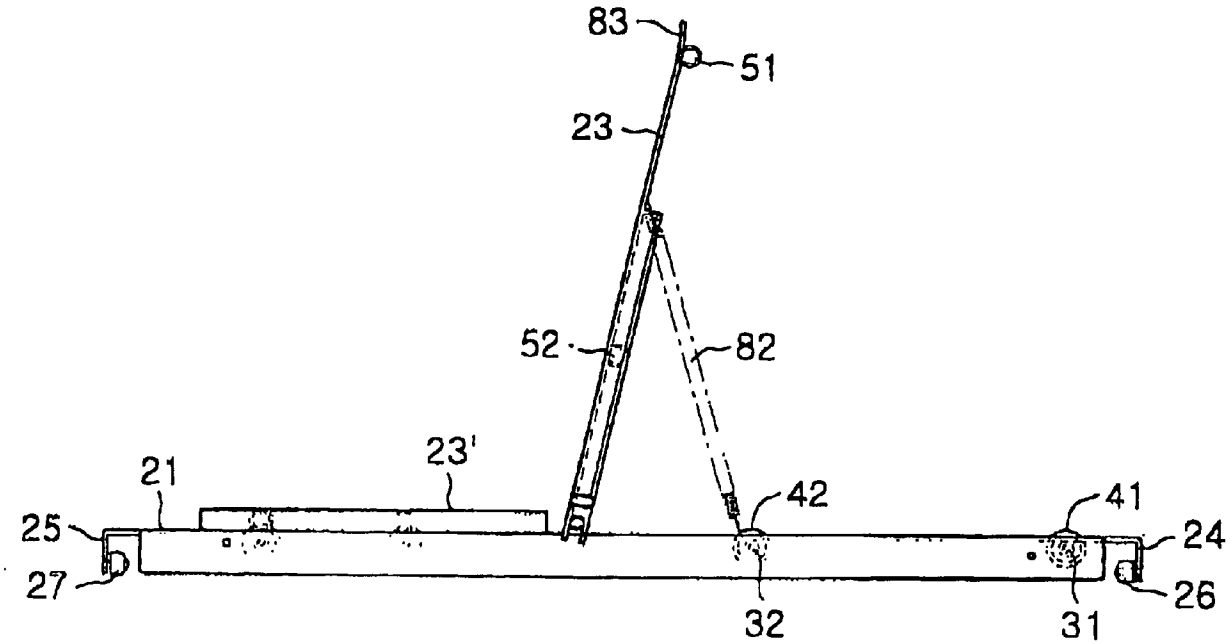
FIG. 10 is a front view showing a state that cover plate is raised in order to explain an operation of removing a jammed paper sheet.

If the recording paper is jammed in multipurpose feeding unit assembly 20, after the paper jam is detected, first, a user pulls multipurpose feeding unit assembly 20 in a direction corresponding to arrow E of FIG. 6. At this time, grasping groove 22*a* in front cover 22 assists in the withdrawing operation of multipurpose feeding unit assembly 20. Then, after multipurpose feeding unit assembly 20 is withdrawn by a desired length, the user raises cover plate 23 upward. Cover plate 23 is then revolved with hinge shaft 81 in the center, so that a portion between feeding rollers 41 and 42 and pinch rollers 51 and 52 is exposed to the outside. Therefore, the user can easily remove the jammed paper.

After that, the user pushes multipurpose feeding unit assembly 20 in the direction of arrow F of FIG. 6, so that multipurpose feeding unit assembly 20 is received again in receiving space 11. When the receiving operation of multipurpose feeding unit assembly 20 is completed, position guiding members 71 formed at the rear side of multipurpose feeding unit assembly 20 are entered into position guiding holes 74 formed at the inner portion of main body 10. Therefore, the position of the multipurpose feeding unit assembly 20 is exactly guided and prevented from being arbitrarily moved forward.

While the invention has been described in connection with specific and preferred embodiments thereof, it is capable of further modifications without departing from the spirit and scope of the invention. This application is intended to cover all variations, uses, or adaptations of the invention, following, in general, the principles of the invention and including such departures from the present disclosure as come within known or customary practice within the art to which the invention pertains, or as are obvious to persons skilled in the art, at the time the departure is made. It should be appreciated that the scope of this invention is not limited to the detailed description of the invention hereinabove, which is intended merely to be illustrative, but rather comprehends the subject matter defined by the following claims.

What is claimed is:

1. A printer, comprising:

a main body having an optional auxiliary device located at a first side thereof;

a feeding unit for feeding sheets of recording paper, located at a second side of the main body;

a feeding unit assembly removably mounted in the main body, for transporting the sheets of recording paper from said second side towards said first side via a first paper transport path, said feeding unit assembly comprising:

a base unit having a first plurality of feed rollers for feeding said sheets of recording paper along said first paper transport path;

a first cover plate rotatably positioned over said first paper transport path, a first end of said first cover plate being rotatable about a hinge shaft;

an elastic member attached between said first cover plate and said base unit; and a grasping portion formed on a second end of said first cover plate, distal to said first end, said grasping portion enabling said first cover plate to be opened, thereby enabling any jammed sheets of paper in said first paper transport path to be removed.

2. The printer set forth in claim 1, said first cover plate comprising:

a plurality of openings through said first cover plate;

a plurality of pinch rollers, each of said pinch roller being mounted in respective ones of said openings, each of said pinch rollers being positioned over corresponding ones of said feed rollers when said first cover plate is in a closed position.

3. The printer set forth in claim 1, said feeding unit assembly further comprising:

said base unit having a second plurality of feed rollers for feeding said sheets of recording paper along said first paper transport path to an outlet of said feeding unit assembly; and a second cover plate positioned over said second plurality of feed rollers.

4. The printer set forth in claim 3, said first and second cover plates each comprising:

a plurality of openings through said first and second cover plates;

a plurality of pinch rollers, each of said pinch roller being mounted in respective ones of said openings, each of said pinch rollers being positioned over corresponding ones of said feed rollers when said first cover plate is in a closed position.

5. The printer set forth in claim 1, said optional auxiliary device comprising a duplex module.

6. The printer set forth in claim 5, further comprising:

a paper feeding cassette mounted below said feeding unit assembly; and first and second paper guiding chutes;

said paper feeding cassette feeding sheets of paper towards a predetermined location via a second paper transport path formed between said first and second paper guiding chutes;

said feeding unit assembly feeding sheets of paper towards said predetermined location via said second paper guiding chute; and said duplex module feeding sheets of paper towards said predetermined location via a third paper transport path defined by said first paper guiding chute and said second paper guiding chute.

7. The printer set forth in claim 1, further comprising:

a receiving unit in said main body for receiving said feeding unit assembly; and a plurality of guide rollers mounted to a lower portion of said base unit to enable said feeding unit assembly to be reciprocally moved into and out of said receiving unit.

8. The printer set forth in claim 1, further comprising:

roller shafts, said feed rollers being mounted on said roller shafts;

a motor driven transmission gear mounted on one of said roller shafts;

belt driven pulleys fixed to one end of each of said roller shafts for rotating said roller shafts and said feed rollers in a predetermined direction in response to rotational power applied to said motor driven transmission gear; and drive belts interconnecting said belt driven pulleys for transferring said rotational power from said one of said roller shafts to said remaining roller shafts.

9. A printer, comprising:

a main body having a receiving unit in said main body, said receiving unit having an inlet and an outlet;

a feeding unit assembly removably mounted in said receiving unit for transporting sheets of recording paper from said inlet to said outlet via a first paper transport path, said feeding unit assembly comprising:

a base unit having a first plurality of feed rollers for feeding said sheets of recording paper along said first paper transport path;

a first cover plate rotatably positioned over said first paper transport path, a first end of said first cover plate being rotatable about a hinge shaft, said first cover plate comprising:

a plurality of openings through said first cover plate; and a plurality of pinch rollers, each of said pinch roller being mounted in respective ones of said openings, each of said pinch rollers being positioned over corresponding ones of said feed rollers when said first cover plate is in a closed position.

10. The printer set forth in claim 9, further comprising:

an elastic member attached between said first cover plate and said base unit; and a grasping portion formed on a second end of said first cover plate, distal to said first end, said grasping portion enabling said first cover plate to be opened, thereby enabling any jammed sheets of paper in said first paper transport path to be removed.

11. The printer set forth in claim 9, said feeding unit assembly further comprising:

said base unit having a second plurality of feed rollers for feeding said sheets of recording paper along said first paper transport path to said outlet; and a second cover plate positioned over said second plurality of feed rollers, said second cover plate comprising:

a second plurality of openings through said second cover plate; and a second plurality of pinch rollers, each of said pinch roller being mounted in respective ones of said openings through said second cover plate, each of said second plurality of pinch rollers being positioned over corresponding ones of said second plurality of feed rollers.

12. The printer set forth in claim 11, further comprising:

roller shafts, said feed rollers being mounted in pairs on said roller shafts;

a motor driven transmission gear mounted on one of said roller shafts;

belt driven pulleys fixed to one end of each of said roller shafts for rotating said roller shafts and said feed rollers in a predetermined direction in response to rotational power applied to said motor driven transmission gear; and drive belts interconnecting said belt driven pulleys for transferring said rotational power from said one of said roller shafts to said remaining roller shafts.

13. The printer set forth in claim 9, further comprising:

an optional auxiliary device mounted at a first side of said main body; and a feeding unit mounted at a second side of said main body for feeding said sheets of recording paper into said inlet.

14. The printer set forth in claim 13, said optional auxiliary device comprising a duplex module.

15. The printer set forth in claim 14, further comprising:

a paper feeding cassette mounted below said feeding unit assembly; and first and second paper guiding chutes;

said paper feeding cassette feeding sheets of paper towards a predetermined location via a second paper transport path formed between said first and second paper guiding chutes;

said feeding unit assembly feeding sheets of paper towards said predetermined location via said second paper guiding chute; and said duplex module feeding sheets of paper towards said predetermined location via a third paper transport path defined by said first paper guiding chute and said second paper guiding chute.

16. The printer set forth in claim 9, further comprising a plurality of guide rollers mounted to a lower portion of said base unit to enable said feeding unit assembly to be reciprocally moved into and out of said receiving unit.

17. The printer set forth in claim 9, further comprising:

roller shafts, said feed rollers being mounted on said roller shafts;

a motor driven transmission gear mounted on one of said roller shafts;

belt driven pulleys fixed to one end of each of said roller shafts for rotating said roller shafts and said feed rollers in a predetermined direction in response to rotational power applied to said motor driven transmission gear; and drive belts interconnecting said belt driven pulleys for transferring said rotational power from said one of said roller shafts to said remaining roller shafts.

* * * * *